US009673503B1

(12) United States Patent
Aster

(10) Patent No.: US 9,673,503 B1
(45) Date of Patent: Jun. 6, 2017

(54) SYSTEMS AND METHODS FOR COMBINING OR DIVIDING MICROWAVE POWER

(71) Applicant: David B. Aster, Spokane Valley, WA (US)

(72) Inventor: David B. Aster, Spokane Valley, WA (US)

( * ) Notice: Subject to any disclaimer, the term of this patent is extended or adjusted under 35 U.S.C. 154(b) by 0 days.

(21) Appl. No.: 15/043,570

(22) Filed: Feb. 14, 2016

Related U.S. Application Data

(60) Provisional application No. 62/140,390, filed on Mar. 30, 2015.

(51) Int. Cl.
*H01P 5/12* (2006.01)
*H01P 11/00* (2006.01)
*H01P 1/202* (2006.01)

(52) U.S. Cl.
CPC ..... *H01P 5/12* (2013.01); *H01P 1/202* (2013.01); *H01P 11/001* (2013.01); *H01P 11/007* (2013.01)

(58) Field of Classification Search
CPC ..... H01P 5/12; H01P 1/202; H01P 11/001; H01P 11/007
USPC ..... 333/137
See application file for complete search history.

(56) References Cited

U.S. PATENT DOCUMENTS 2,946,965 A * 7/1960 Albanese ..... H01P 5/20 333/121
3,931,587 A 1/1976 Harp et al.
4,032,865 A 6/1977 Harp et al.
4,152,680 A 5/1979 Harrison
4,188,590 A 2/1980 Harp et al.
4,238,747 A 12/1980 Harp et al.
(Continued)

OTHER PUBLICATIONS

Kenneth J. Russell, 'Microwave power combining techniques,' IEEE Transactions on Microwave Theory and Techniques, May 1979, pp. 472-478.

(Continued)

*Primary Examiner* — Robert Pascal
*Assistant Examiner* — Kimberly Glenn
(74) *Attorney, Agent, or Firm* — Deepak Malhotra; Malhotra Law Firm, PLLC

(57) ABSTRACT

A power combiner/divider includes a main conductor defining an axis; an input connector having a center conductor, adapted to be coupled to a signal source, electrically coupled to the main conductor and having an axis aligned with the main conductor axis, and having a second conductor electrically coupled to a ground conductor; a plurality of satellite conductors radially exterior of and spaced apart from the main conductor, the satellite conductors defining the general shape of a slotted hollow cylinder having a cylinder axis aligned with the main conductor axis; a plurality of output connectors having respective axes that are perpendicular to the main conductor axis, the output connectors being radially spaced apart relative to the main conductor, the output connectors having center conductors electrically coupled to respective satellite conductors and having respective second conductors electrically coupled to a second ground conductor; and a multiconductor transmission line, including the satellite conductors, defined between the input connector and the output connectors. Methods of manufacturing are also disclosed.

25 Claims, 13 Drawing Sheets

(56) References Cited

U.S. PATENT DOCUMENTS

| | | | | |
|---|---|---|---|---|
| 4,266,208 | A | 5/1981 | Cornish | |
| 4,453,139 | A | 6/1984 | Labaar | |
| 4,598,254 | A | 7/1986 | Saito et al. | |
| 4,694,260 | A | 9/1987 | Argintaru et al. | |
| 4,700,145 | A * | 10/1987 | Yelland | H01P 5/12 330/286 |
| 4,835,496 | A | 5/1989 | Schellenberg et al. | |
| 5,389,890 | A | 2/1995 | Burrage | |
| 5,644,272 | A | 7/1997 | Dabrowski | |
| 5,777,527 | A | 7/1998 | Sanders | |
| 5,784,033 | A | 7/1998 | Boldissar, Jr. | |
| 5,847,625 | A | 12/1998 | Gillette | |
| 6,005,450 | A | 12/1999 | Schmidt et al. | |
| 6,018,277 | A | 1/2000 | Vaisanen | |
| 6,919,776 | B1 | 7/2005 | Mobius et al. | |
| 7,102,459 | B1 | 9/2006 | Arnold et al. | |
| 7,215,218 | B2 | 5/2007 | Burns et al. | |
| 7,397,328 | B2 | 7/2008 | Yasuda et al. | |
| 7,468,640 | B2 | 12/2008 | Nosaka | |
| 7,479,850 | B2 | 1/2009 | Kearns et al. | |
| 8,508,313 | B1 | 8/2013 | Aster | |
| 9,065,163 | B1 * | 6/2015 | Wu | H01P 3/12 |
| 2013/0335162 | A1 * | 12/2013 | Sun | H01P 5/12 333/127 |

OTHER PUBLICATIONS

Clayton R. Paul, Analysis of Multiconductor Transmission Lines, John Wiley & Sons, New York, New York, 1994, pp. 219-222.

G. C. Temes and S. K. Mitra, Modern Filter Theory and Design, John Wiley & Sons, New York, New York, 1973, pp. 276-284.

G. C. Temes and S. K. Mitra, Modern Filter Theory and Design, John Wiley & Sons, New York, New York, 1973, pp. 306-308.

"Choosing the Best Power Divider for the Task of Signal Combining" retrieved from: http://www.microlab.fxrcom/resource-library?brand=Microlab&go=application_notes, downloaded and printed on Feb. 6, 2016 (6 pages).

"Reactive vs. Wilkinson Splitters" retrieved from: http://www.microlab.fxr.com/resource-library?brand=Microlab &go=application_notes, downloaded and printed on Feb. 6, 2016 (2 pages).

"Dividers & Combiners" retrieved from: http://www.microlab.fxr.com/resource-library?brand=Microlab&go=application_notes, downloaded and printed on Feb. 6, 2016 (4 pages).

Wilkinson, Ernest J., An N-Way Hybrid Power Divider, Jan. 1960, pp. 116-118, IRE Transactions on Microwave Theory and Techniques.

Horton, M.G., and Wenzel, R.J., General Theory and Design of Optimum Quarter-Wave TEM Filters, May 1965, pp. 316-327, IEEE Transactions on Microwave Theory and Techniques.

* cited by examiner

Section a1 - a1

Section a2 - a2

Section 9 - 9

Section 13 - 13

C11 = 4.3386 E-10 farads/m
C12 = -4.3381 E-11 farads/m
C13 = -4.3384 E-11 farads/m C21 = -4.3381 E-11 farads/m
C22 = 1.2749 E-10 farads/m
C23 = -1.8486 E-11 farads/m
C24 = 8.3920 E-18 farads/m $$\underline{\underline{Y}} = v\underline{\underline{C}} = \begin{bmatrix} .1300 & -.0130 & -.0130 & -.0130 & -.0130 & -.0130 & -.0130 & -.0130 & -.0130 & -.0130 & -.0130 \\ -.0130 & .0382 & -.0055 & 0 & 0 & 0 & 0 & 0 & 0 & 0 & -.0055 \\ -.0130 & -.0055 & .0382 & -.0055 & 0 & 0 & 0 & 0 & 0 & 0 & 0 \\ -.0130 & 0 & -.0055 & .0382 & -.0055 & 0 & 0 & 0 & 0 & 0 & 0 \\ -.0130 & 0 & 0 & -.0055 & .0382 & -.055 & 0 & 0 & 0 & 0 & 0 \\ -.0130 & 0 & 0 & 0 & -.0055 & .0382 & -.0055 & 0 & 0 & 0 & 0 \\ -.0130 & 0 & 0 & 0 & 0 & -.0055 & .0382 & -.0055 & 0 & 0 & 0 \\ -.0130 & 0 & 0 & 0 & 0 & 0 & -.0055 & .0382 & -.0055 & 0 & 0 \\ -.0130 & 0 & 0 & 0 & 0 & 0 & 0 & -.0055 & .0382 & -.0055 & 0 \\ -.0130 & 0 & 0 & 0 & 0 & 0 & 0 & 0 & -.0055 & .0382 & -.0055 \\ -.0130 & -.0055 & 0 & 0 & 0 & 0 & 0 & 0 & 0 & -.0055 & .0382 \end{bmatrix}$$

$Y_{10}$ = 1.843 E-5 mho $= Y_{11} + N_S Y_{12}$ $Y_{20}$ = 0.0141 mho $= Y_{22} + Y_{12} + \sum_{P=3}^{N_S+1} Y_{2P}$

Fig. 14

$Y_1$ = 1 / 36.8 mho
$Y_2$ = 1 / 19.1 mho
$N_s|Y_{12}|$ = 0.130 mho
$N_s\ Y_{20}$ = 0.141 mho
$N_s\ Y_L$ = 0.200 mho
$Y_{10}$ = 0 mho

SYSTEMS AND METHODS FOR COMBINING OR DIVIDING MICROWAVE POWER

CROSS REFERENCE TO RELATED APPLICATION

This application claims priority to U.S. Provisional Patent Application Ser. No. 62/140,390 titles SYSTEMS AND METHODS OF DIVIDING OR COMBINING MICROWAVE POWER, by David Aster, filed Mar. 30, 2015, and incorporated herein by reference.

TECHNICAL FIELD

The technical field includes methods and apparatus for summing (or combining) the power of a number of isolator-protected power sources or for dividing power into a number of separate divided output signals.

BACKGROUND

The communications and radar industries have interest in reactive-type broadband high-power microwave dividers and combiners. Even though not all ports are RF matched, as compared to the Wilkinson power divider/combiner (see Ernest J. Wilkinson, "An N-way hybrid power divider," IRE Trans. on Microwave Theory and Techniques, January 1960, pp. 116-118), the reactive-type mechanical and electrical ruggedness is an advantage for high-power combiner applications. This assumes that the sources to be combined are isolator-protected and of equal amplitude and phase.

An example of prior art, commercially available 6-way reactive power divider (Model D6-85FE by Microlab/FXR) is shown in FIGS. 1 and 2. Microwave power into a 50 ohm coax input port 101 enters a coaxial stepped impedance transformer 102 followed by a 6-way divider port structure 104. Equally-divided power exits the six 50 ohm output connectors 103. The coaxial impedance transformer 102 is designed to minimize reflected power over a desired passband frequency range $f_1$ to $f_2$. FIG. 3 shows a generalized equivalent electrical circuit for this type of reactive power divider. A simple stepped-impedance transformer is typically used, shown in FIG. 3 as transformer sections having characteristic impedances $Z_1$ through $Z_T$ with respective phase lengths $\theta_1$ through $\theta_T$—usually each a quarter-wavelength at the mid-band frequency within the passband. The input port 101 (FIGS. 1, 2) impedance is $Z_S$, and each output port 103 impedance is $Z_L$. The quantity N output ports are connected in parallel at a common junction, so that the circuit load impedance is $Z_L/N$ (FIG. 3). Values for the transformer characteristic impedances $Z_1$ through $Z_T$ are dependent on the desired voltage standing wave ratio (VSWR) over the frequency range $f_1$ to $f_2$, as well as the source and load impedance quantities $Z_S$ and $Z_L/N$. For broadband applications, this type of reactive power divider is physically quite long, because of the limitation of using a simple quarter-wave stepped impedance transformer between a 50 ohm source impedance and a 50/N ohm load impedance.

Another prior art reactive combiner/divider example is U.S. Pat. No. 8,508,313 to Aster, incorporated herein by reference. Broadband operation is achieved using two or more stages of multiconductor transmission line (MTL) power divider modules. An 8-way reactive power divider/combiner 200 of this type is shown in FIGS. 4 and 5. Described as a power divider, microwave input power enters coax port 201, which feeds a two-way MTL divider 202. Input power on the main center conductor 206 (FIG. 6*a*, Section a1-a1) is equally divided onto two satellite conductors 207 which in turn each feed quarter-wave transmission lines housed in module 203 (FIG. 4). Each of these quarter-wave lines feeds a center conductor 208 (FIG. 6*b*, Section a2-a2) in its respective four-way MTL divider module 204, power being equally divided onto satellite conductors 209 which in turn feed output coax connectors 205. This may also be described as a two-stage MTL power divider where the first stage two-way divider (Stage B, FIG. 7) feeds a second stage (Stage A, FIG. 7) consisting of two 4-way MTL power dividers, for a total of eight outputs 205 of equally divided power. This two-stage divider network is described electrically in FIG. 7 as a shorted shunt stub ladder filter circuit with a source admittance $Y_S^{(B)}$ and a load admittance $N_S^{(B)}N_S^{(A)}Y_L^{(A)}$. The first-stage (Stage B) quarter-wave shorted shunt stub transmission line characteristic admittances have values $Y_{10}^{(B)}$ and $N_S^{(B)}Y_{20}^{(B)}$, respectively, which are separated by a quarter-wave main line with characteristic admittance value $N_S^{(B)}Y_{12}^{(B)}$. Here the number of satellite conductors $N_S^{(B)}=2$, $N_S^{(A)}=4$ and $Y_{12}^{(B)}$ is the value of the row 1, column 2 element of the 3×3 characteristic admittance matrix $Y^{(B)}$ for the two-way MTL divider (Section a1-a1, FIG. 6). Also, $Y_{10}^{(B)}=Y_{11}^{(B)}+N_S^{(B)}Y_{12}^{(B)}$ and $Y_{20}^{(B)}=Y_{22}^{(B)}+Y_{12}^{(B)}+Y_{23}^{(B)}$. Each quarter-wave transmission line within housing 203 (FIG. 4) has characteristic admittance $Y_T$ and is represented in the equivalent circuit FIG. 7 as a quarter-wave main transmission line with characteristic admittance $N_S^{(B)}Y_T$. The second stage (Stage A) quarter-wave shorted shunt stub transmission line characteristic admittances have values $N_S^{(B)}Y_{10}^{(A)}$ and $N_S^{(B)}N_S^{(A)}Y_{20}^{(A)}$, respectively, which are separated by a quarter-wave main line with characteristic admittance $N_S^{(B)}N_S^{(A)}Y_{12}^{(A)}$. Here $Y_{12}^{(A)}$ is the value of the row 1, column 2 element of the 5×5 characteristic admittance matrix $Y^{(A)}$ for one of the two identical four-way MTL divider modules 204 (FIG. 4) with cross-section a2-a2 in FIG. 6*b*. A plot of scattering parameters for an octave bandwidth two-stage eight-way divider is shown in FIG. 4*c* of U.S. Pat. No. 8,508,313. Due to its complexity, the two-stage, three MTL module power divider/combiner as shown in FIGS. 4 and 5 is expensive to fabricate.

SUMMARY

Some embodiments provide a power divider (or combiner) including a main conductor defining an axis; an input connector having a center conductor, adapted to be coupled to a signal source, electrically coupled to the main conductor and having an axis aligned with the main conductor axis, and having a second conductor electrically coupled to a ground conductor; a plurality of satellite conductors radially exterior of and spaced apart from the main conductor, the satellite conductors defining the general shape of a slotted hollow cylinder having a cylinder axis aligned with the main conductor axis; a plurality of output connectors having respective axes that are perpendicular to the main conductor axis, the output connectors being radially spaced apart relative to the main conductor, the output connectors having center conductors electrically coupled to respective satellite conductors and having respective second conductors electrically coupled to a second ground conductor; and a multiconductor transmission line, including the satellite conductors, defined between the input connector and the output connectors.

Other embodiments provide a power divider/combiner including a main conductor defining an axis, and having a length along the axis, the main conductor having multiple different diameters along its length defining multiple portions; an input connector having a center conductor, adapted to be coupled to a signal source, electrically coupled to the main conductor and having an axis aligned with the main conductor axis, and having a second conductor, the input connector defining a first end of the divider/combiner, the divider/combiner having a second end axially spaced apart from the first end; a first ground conductor radially exterior of the main conductor and coupled to the second conductor of the input connector; an electrically and thermally conducting inner backplate, axially between the first ground conductor and the second end, radially exterior of the main conductor; a plurality of satellite conductors radially exterior of and radially spaced apart from one of the portions of the main conductor, the satellite conductors defining the general shape of a slotted hollow cylinder having a cylinder axis aligned with the main conductor axis, the satellite conductors having inner ends electrically connected to the inner backplate and outer ends extending towards the second end; a plurality of output connectors having respective axes that are perpendicular to the main conductor axis, the output connectors being radially spaced apart relative to the main conductor axis, the output connectors having center conductors electrically coupled to respective outer ends of the satellite conductors and having respective second conductors electrically coupled to a second ground conductor; a second ground conductor radially exterior of the satellite conductors and axially between the inner backplate and the second end; and an electrically and thermally conducting outer backplate at the second end electrically coupled to the main conductor and spaced apart from the satellite conductors by a gap.

Other embodiments provide a method of manufacturing a power divider/combiner, the method including providing a main conductor defining an axis; providing a coax input connector having a center conductor, adapted to be coupled to a signal source and having an axis aligned with the main conductor axis; electrically coupling the input connector to the main conductor; providing a plurality of satellite conductors radially exterior of and spaced apart from the main conductor, the satellite conductors defining the general shape of a slotted hollow cylinder having a cylinder axis aligned with the main conductor axis; providing a plurality of coax output connectors having respective axes that are perpendicular to the main conductor axis, the output connectors being radially spaced apart relative to the main conductor, the output connectors having center conductors; electrically coupling the respective center conductors of the output connectors to the satellite conductors; defining a multiconductor transmission line between the inner backplate and the output connectors; and defining a passband filter between the input connector and the output connectors.

BRIEF DESCRIPTION OF THE VIEWS OF THE DRAWINGS

FIG. 14 is a table showing an admittance matrix Y of the multiconductor transmission line shown in FIG. 13.

DETAILED DESCRIPTION OF THE ILLUSTRATED EMBODIMENTS

Figure 8:
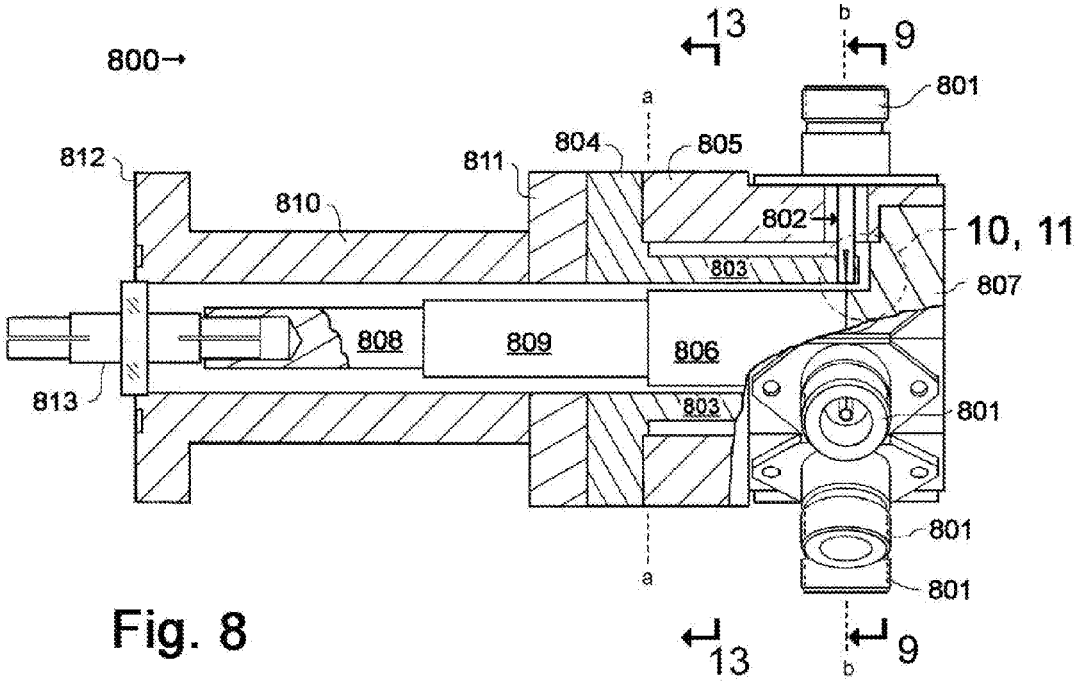
FIG. 8 is a side view of a combiner/divider in accordance with various embodiments, partly in section.

FIG. 8 shows a microwave power divider 800, which can alternatively be used as a power combiner, in accordance with various embodiments. It will hereinafter be referred to as a power divider-combiner 800.

Hereinafter described as if for use as a power divider, the power divider-combiner 800 has (see FIGS. 8, 9, 10, 11, 16, 18) a single main input port flange 812, a center conductor bullet 813, and a quantity $N_S$ of output port connectors 801. It is to be understood that, for convenience, the terms "input" and "output", when used herein and in the claims, assume that the divider-combiner is being used as a power divider. The roles of the inputs and outputs are reversed when the divider-combiner is being used as a power combiner. In the illustrated embodiments, the input port flange 812 is a 7/8 EIA (Electronic Industries Association) flange; however, other sizes or connector types are possible. The power divider-combiner 800 further has (see FIG. 16 and FIGS. 8, 9) ten Type N (female) connectors for the output ports 801. In other embodiments, the input connector possibilities are 7-16 DIN, 4.1-9.5 DIN, Type N (female or male), TNC (female or male), or possibly larger EIA flange types. Other types of output and input RF connectors are possible.

Figure 10:
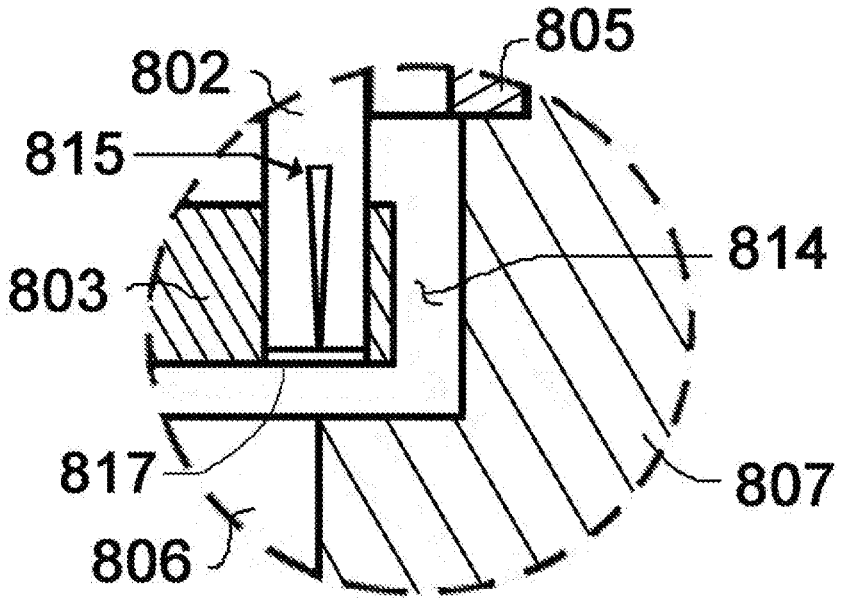
FIG. 10 is a partial view of FIG. 8.
Figure 11:
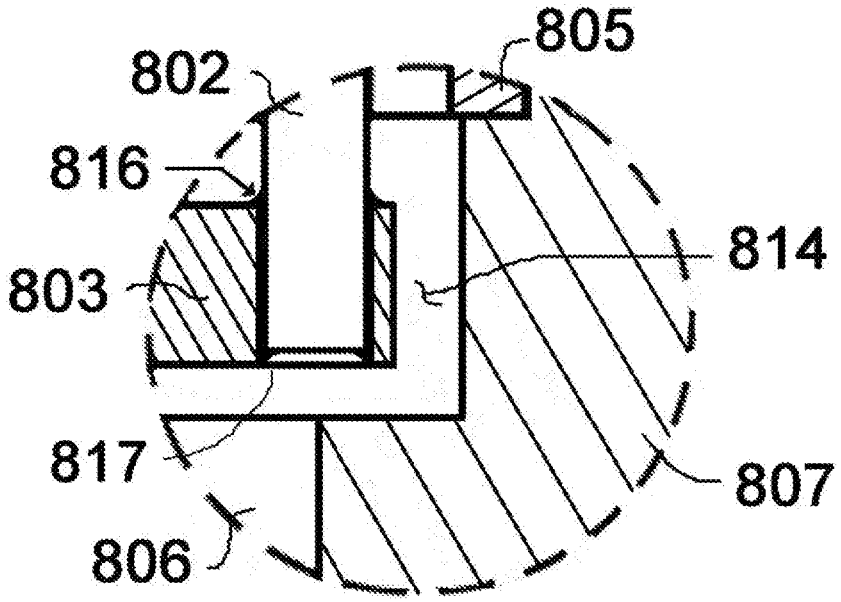
FIG. 11 is an alternate partial view of FIG. 8.
Figure 18:
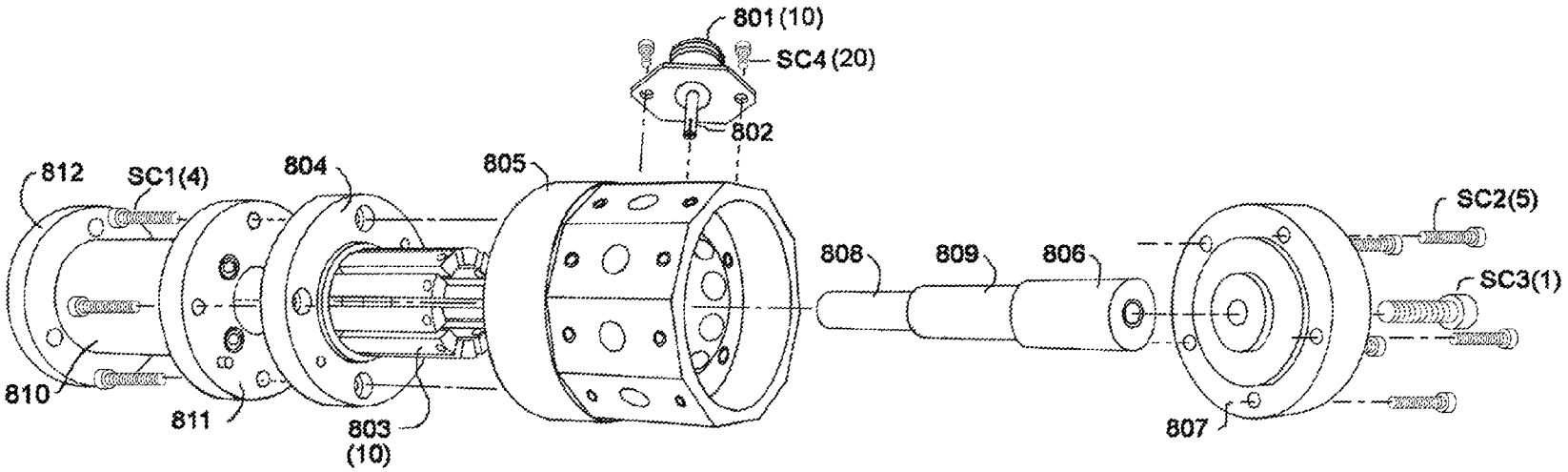
FIG. 18 is an exploded perspective view of the power combiner/divider of FIG. 8.

The power divider-combiner 800 includes a plurality of satellite conductors 803 defining, in the illustrated embodiments, the general shape of a slotted hollow cylinder (see FIG. 18 exploded view). Other cross-section shapes are possible for each conductor 803, such as a circular cross-section, for example. Respective output RF connectors 801 have a center conductor 802 electrically connected with an outer end of one of the satellite conductors 803. FIG. 10 shows center conductor 802 with its end slotted (815) compression fit into a receiving bore 817 located near the end of conductor 803. In an alternate connection method, FIG. 11 shows center conductor 802 attached with solder or braze alloy 816 into the bore 817 to form the electrical and thermal connection to satellite conductor 813. The power divider-combiner 800 includes a stepped diameter center conductor including portions 808, 809, and 806 which are electrically connected to each other. The portions 808, 809, and 806 are cylindrical in the illustrated embodiments; however, other shapes are possible. The power divider-combiner 800 further includes an electrically and thermally conducting outer backplate 807 to which portion 806 of the main center conductor connects.

In the illustrated embodiments, there is a quantity NS of such satellite conductors 803 uniformly spaced about the main center conductor portion 806, and positioned radially exteriorly of the portion 806. The power divider-combiner 800 further includes a sidewall or exterior ground conductor 805. The output RF connectors 801 are radially spaced apart relative to the portion 806, mounted to the sidewall 805, and have aving center conductors 802 passing through the sidewall 805. Further, the RF connector center conductors 802 define respective axes that are all perpendicular to an axis defined by the portion 806 of the main center conductor, in some embodiments. Other angles are possible, including in-line orientation of the RF output connectors out the outer back plate 807, rather than through the sidewall conductor 805.

Main center conductor portions 808, 809, 806, and satellite conductors 803 are substantially one-quarter an electrical wavelength long at the passband midband frequency $f_O$.

The power divider-combiner 800 further includes an inner flange 804 that is electrically and thermally conducting, in the illustrated embodiment. Satellite conductors 803 have respective inner ends that are electrically and thermally connected to the inner backplate 804.

In various embodiments, the portion 806 of the main center conductor, the quantity $N_S$ satellite conductors, and the exterior ground conductor 805 define a multiconductor transmission line (MTL). In the illustrated embodiments, the multiconductor transmission line (MTL) section is preceded by two unit element (quarter-wave) coaxial transmission lines with stepped diameter center conductor portions 808, and 809, and a cylindrical ground conductor 810.

Figure 12:
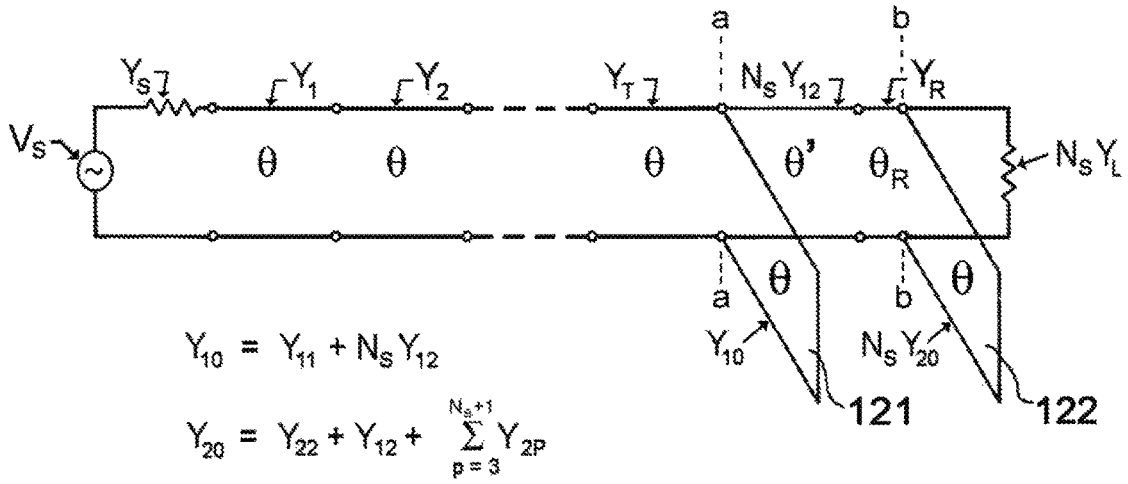
FIG. 12 is an equivalent circuit diagram for the combiner/divider shown in FIG. 8, when it is operated as a power divider.

Collectively, the two unit element transmission lines with characteristic admittances $Y_1$ and $Y_2$, and the MTL section are electrically modeled, in a generalized form, as a passband filter equivalent circuit shown in FIG. 12. A passband is a portion of the frequency spectrum that allows transmission of a signal with a desired minimum insertion loss by means of some filtering device. In other words, a passband filter passes a band of frequencies to a defined passband insertion loss vs. frequency profile. Desired filter passband performance is achieved by a two-step process:

1) Given a source admittance quantity $Y_S$, divider quantity (number of outputs) $N_S$, load admittance quantity $N_S*Y_L$, and desired passband a) bandwidth, and b) input port return loss peaks within the passband, calculate the unit element transmission line characteristic admittances $Y_1$, $Y_2$, . . . , $Y_T$ and MTL unit element characteristic admittance values $N_S|Y_{12}|$, $Y_{10}$, and $N_S*Y_{20}$. This may be accomplished, as one approach, using the design theory as described in M. C. Horton and R. J. Wenzel, "General theory and design of quarter-wave TEM filters," IEEE Trans. on Microwave Theory and Techniques, May 1965, pp. 316-327.

2) After determining the above desired electrical transmission line characteristic admittances, then find corresponding diameters for conductors 808, 809, 810 and determine MTL cross-section dimensions (referring to FIG. 8, and Section 13-13, FIG. 13) that achieve MTL matrix admittance Y element values that give the desired characteristic admittance values $N_S|Y_{12}|$, $Y_{10}$, and $N_S*Y_{20}$. These unit element transmission line characteristic admittances will be described below in greater detail.

For a homogeneous dielectric MTL, its characteristic admittance matrix Y is proportional to a MTL cross-section capacitance matrix C. Referring to the numbered conductors of FIG. 13, the 11×11 capacitance matrix C is defined as follows:

The row 1, column 1 capacitance element C(1,1) hereinafter C11, is found from Q1=C11*V1 where V1 is a voltage applied to conductor 1 (say, 1 volt), with all other conductors 2, 3, . . . up to conductor 11 held at zero volts (the ground conductor shield is always held at zero volts). Q1 is the total surface charge on conductor 1—a positive charge for V1 being positive. Row 1, column 1 element C11=Q1/V1.

The row 1, column 2 element C12 is found from C12=Q2/V1 where V1 is a voltage applied to conductor 1, with all other conductors 2, 3, . . . , 11 held at zero volts—as before. Q2 is the total induced surface charge on conductor 2. This is always a negative value, when V1 is positive.

The row 2, column 2 element C22 is found from Q2=C22*V2 where V2 is a voltage applied to conductor 2 (say, I volt), with all other conductors 1, 3, . . . , 11 held at zero volts. Q2 is the total surface charge on conductor 2—a positive number for V2 positive. Then C22=Q2/V2.

The row 2, column 3 element C23 is found from C23=Q3/V2 where V2 is a voltage applied to conductor 2 (say, I volt), with all other conductors 1, 3, . . . , 11 held at zero volts, as before. Q3 is the total surface charge induced on conductor 3, a negative quantity for positive V2.

The analysis of the above for an arbitrary multiconductor cross-section is based on theory presented by C. Wei, R. Harrington, J. Mautz, and T. Sarkar, "Multiconductor transmission lines in multilayered dielectric media," AEEE Trans. on Microwave Theory and Techniques, Vol. MTT-32, pp. 439-450, April 1984.

The multiconductor transmission line characteristic admittance matrix Y=v*C, where v is the velocity of light. Air dielectric is assumed. The quantity $Y_{12}$ is from the first row, second column of matrix Y. The quantity $Y_{12}$ is seen in FIGS. 7, 12, 14, and 15.

The transmission line characteristic admittances $Y_{10}$ and $Y_{20}$ are derived from elements of the matrix Y, and are defined in FIG. 12 (and also in FIG. 14).

Figure 13:
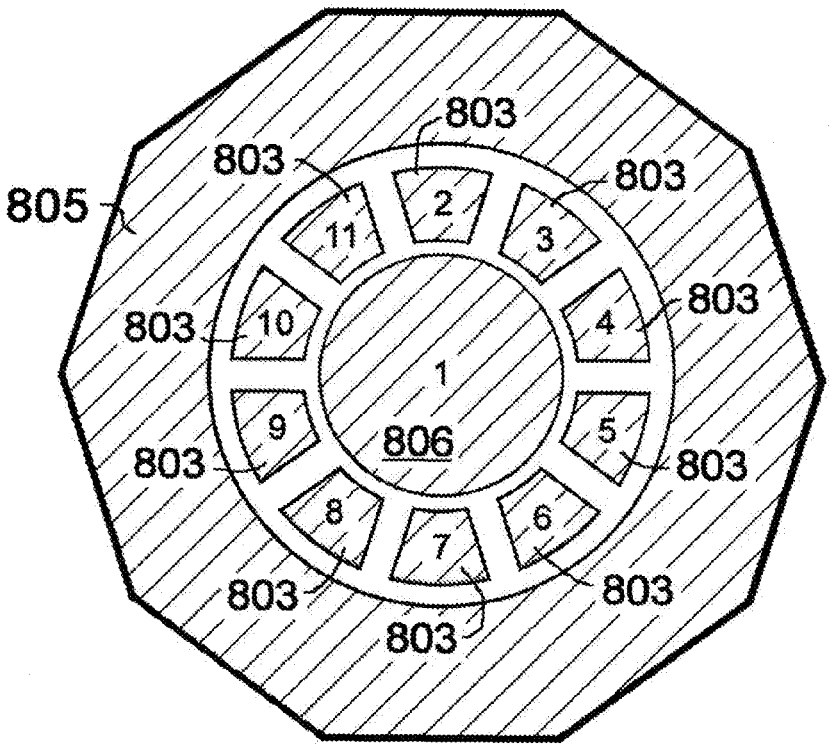
FIG. 13 is a sectional view taken along line 13-13 of FIG. 8.

The MTL physical cross-section dimensions (FIG. 13) are chosen to give the desired values of $Y_{11}$=v*C11, $Y_{12}$=v*C12, $Y_{22}$=v*C22, and $Y_{23}$=v*C23, and thus the desired values for unit elements characteristic admittances $Y_{10}$ and $Y_{20}$, referring to the numbering of conductors shown in FIG. 13. The quantity v is the speed of light in air, and the capacitance matrix elements C11, C12, C22, and C23 have units of farads/meter. The units of $Y_{11}$, $Y_{12}$, $Y_{22}$, $Y_{23}$, $Y_{10}$, and $Y_{20}$ are in mhos.

Figure 15:
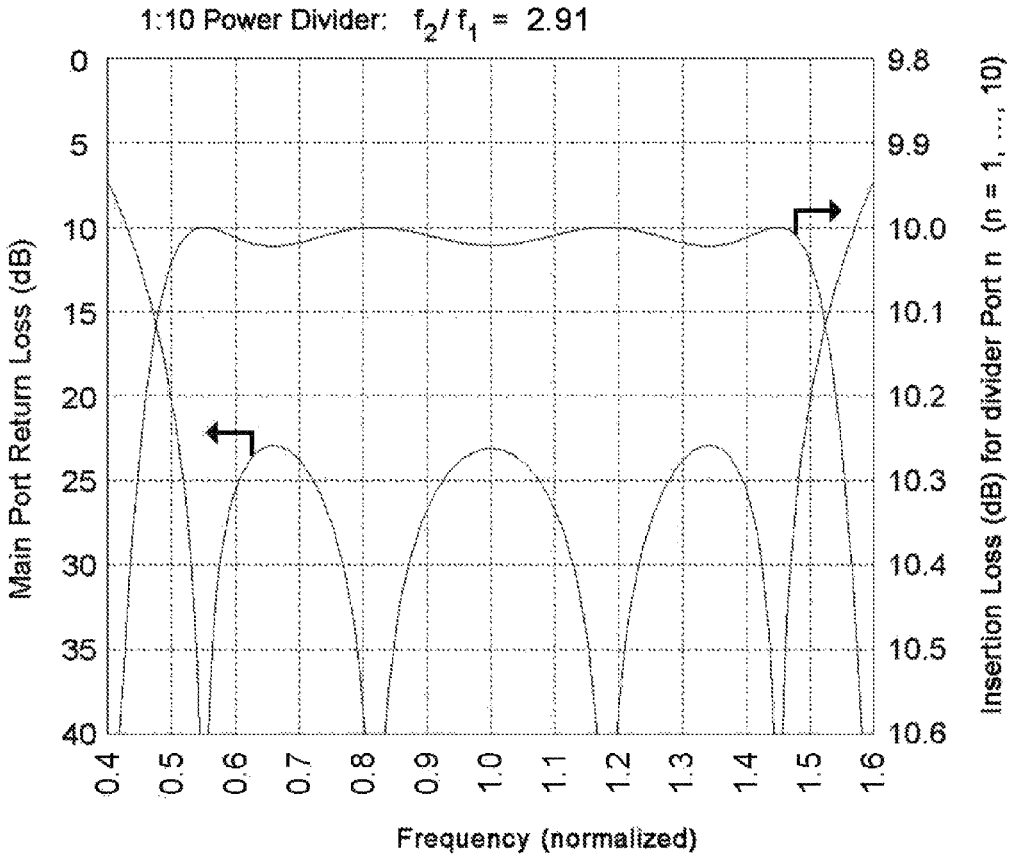
FIG. 15 is a graph showing typical input port return loss and output port insertion loss vs. frequency for embodiments of the combiner/divider of FIG. 8 that have one input port and ten output ports (when being used as a power divider).

As an example, given: $N_S$=10, $Y_S$=$Y_L$=0.02 mho, 23 dB return loss peaks are desired for a bandwidth $F_2/F_1$=2.91, where $F_1$, $F_2$ represent the lower and upper edges of the passband, respectively. Using the Horton & Wenzel technique, unit element characteristic admittances $Y_1$, $Y_2$, and MTL unit element characteristic admittance values $N_S*|Y_{12}|$, $Y_{10}$, and $Y_{20}$ were found. FIG. 15 shows calculated response using these derived characteristic admittances used in the equivalent circuit in FIG. 12. Cross-section dimensions throughout the filter device were then determined so as to achieve these unit element characteristic admittances. While the illustrated embodiments show two coaxial transmission lines preceding the MTL, alternative embodiments built for lesser or broader bandwidth employ only one (narrower bandwidth) or three or more coax unit elements (broader bandwidth) that precede the MTL.

Figure 16:
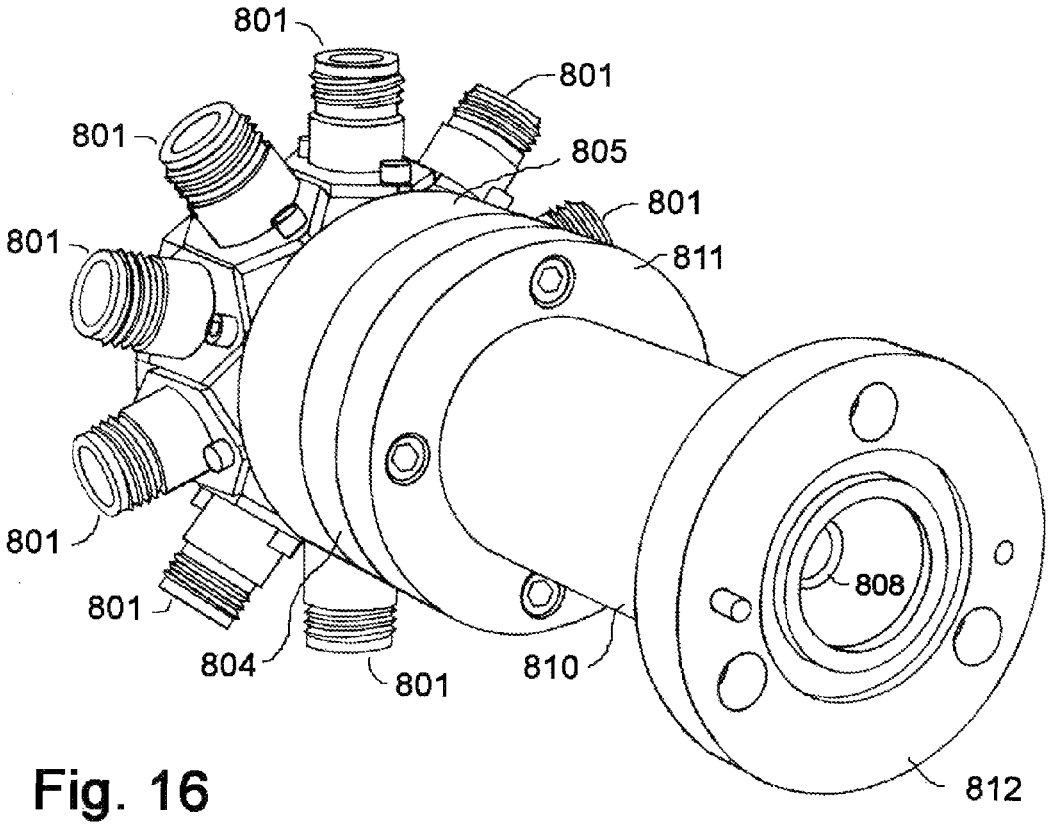
FIG. 16 is a perspective view showing embodiments of the combiner/divider of FIG. 8 that have an Electronic Industries Association (EIA) 7/8 flange main port, and ten Type N (female) connectors for the output ports (when being used as a power divider).
Figure 17:
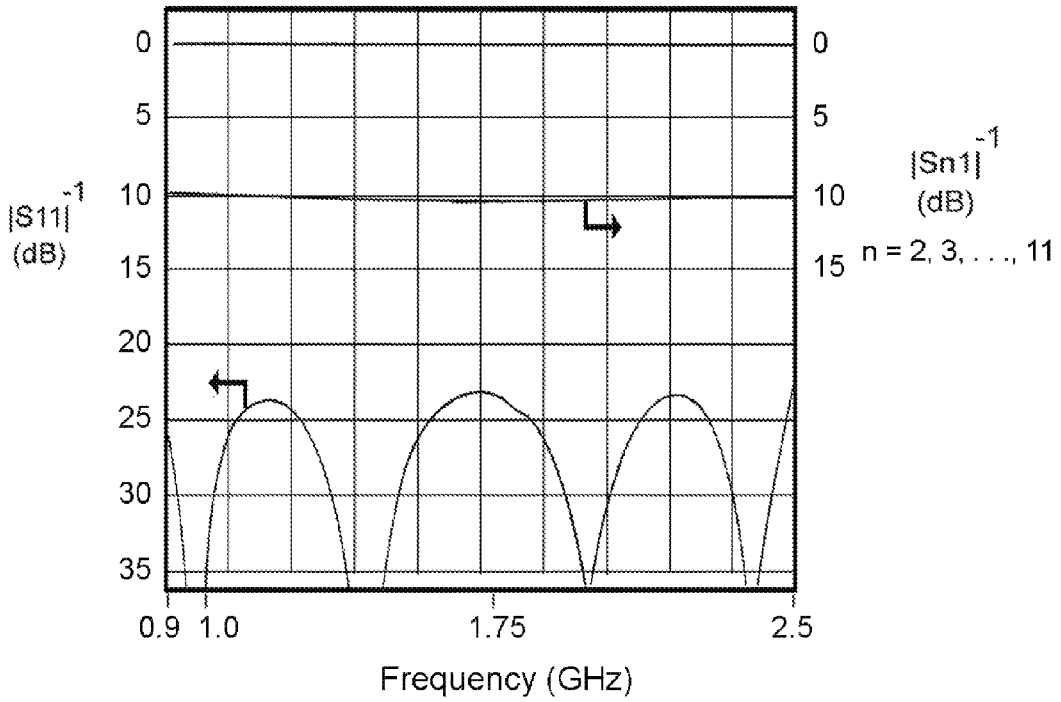
FIG. 17 shows measured RF performance of FIG. 16 of the combiner/divider of FIG. 16, tested as a power divider.

FIG. 17 shows measured RF performance of the combiner/divider of FIG. 16. Tested as a power divider, measured RF performance shows good correlation with predicted main port return loss $|S_{11}|$ and typical output port insertion loss $|S_{n1}|$ vs. frequency.

Figure 1:
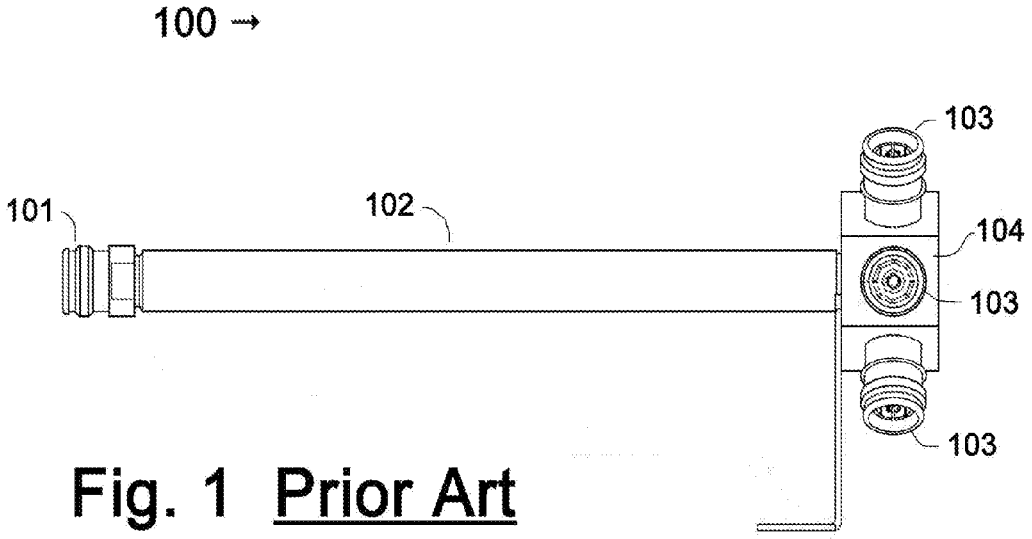
Fig. 1 Prior Art
FIG. 1 is a side view of a commercially available prior art reactive-type divider/combiner.
Figure 2:
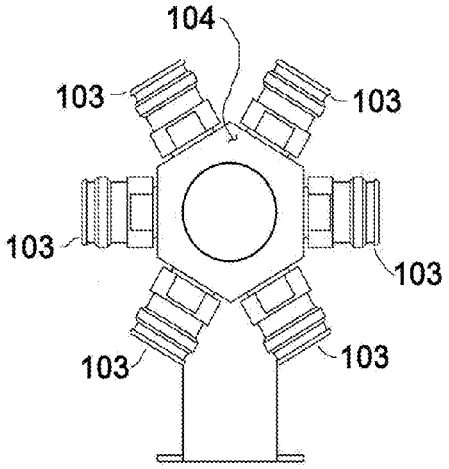
Fig. 2 Prior Art
FIG. 2 is an end view of the prior art divider/combiner of FIG. 1.
Figure 3:
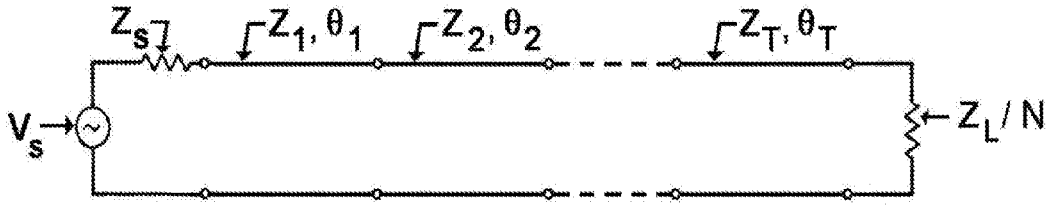
Fig. 3 Prior Art
FIG. 3 is a circuit schematic diagram of an equivalent circuit of a prior art divider/combiner of the type of FIGS. 1 and 2.
Figure 4:
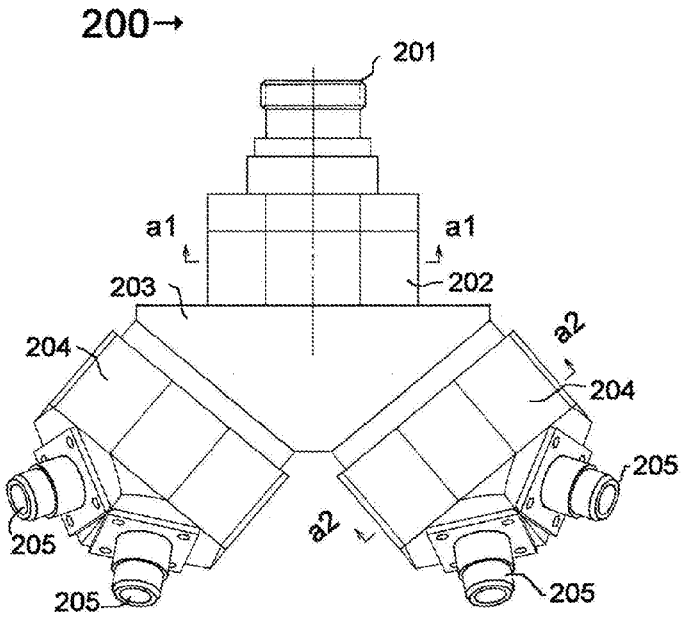
Fig. 4 Prior Art
FIG. 4 is a top view of a prior art reactive-type two-stage multiconductor transmission line divider/combiner.
Figure 6A:
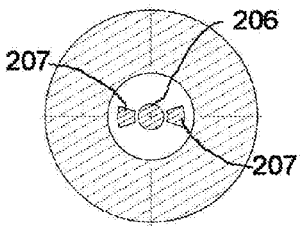
FIG. 6*a* is a sectional view taken along line a1-a1 of FIG. 4.
Figure 6B:
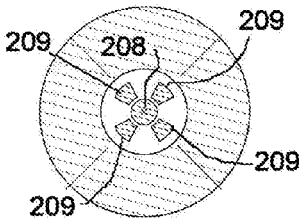
FIG. 6*b* is a sectional view taken along line a2-a2 of FIG. 4.
Figure 5:
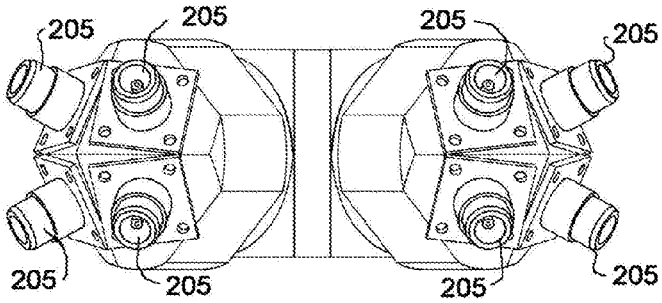
Fig. 5 Prior Art
FIG. 5 is an end view of the prior art divider/combiner of FIG. 4.
Figure 7:
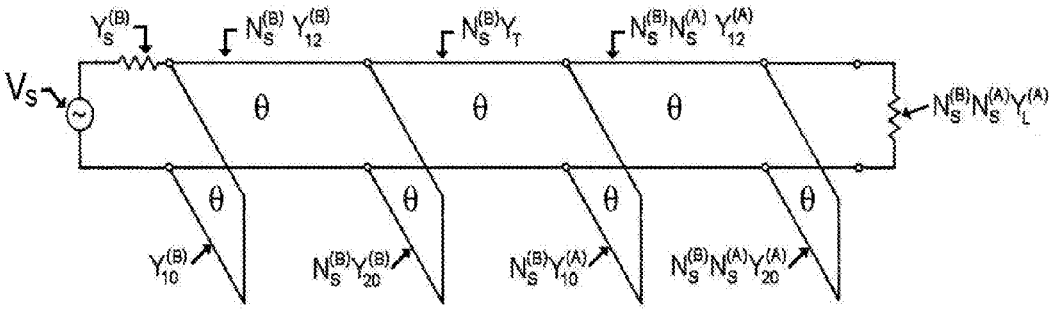
Fig. 7 Prior Art
FIG. 7 is an equivalent circuit diagram for the prior art divider/combiner shown in FIGS. 4, 5, when it is operated as a power divider.
Figure 9:
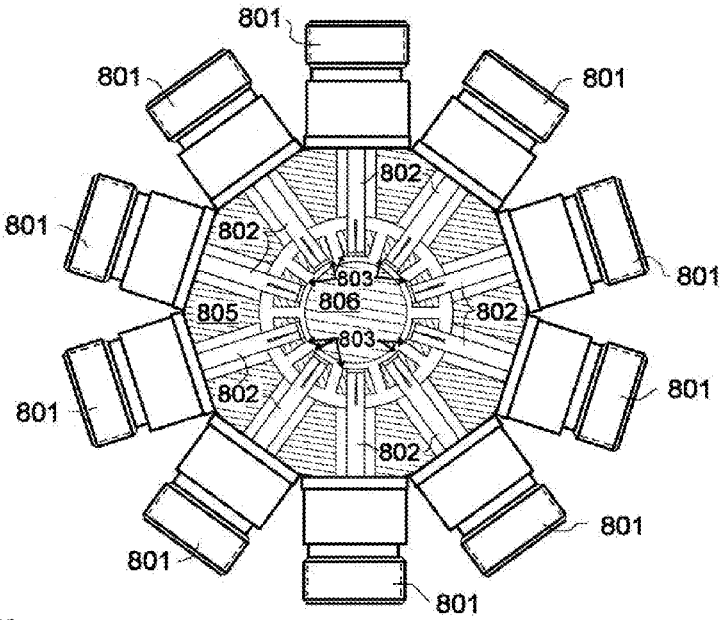
FIG. 9 is a sectional view taken along line 9-9 of FIG. 8.

The total physical length of conductors 808, 809, and 806 (FIG. 8) corresponds to approximately three unit element lengths, whereas the prior art shown in FIGS. 1, 2, (and equivalent circuit FIG. 3) requires a simple quarter-wave impedance transformer length equivalent to four unit elements in order to achieve the same electrical performance, assuming a ten-way divider/combiner. In comparison with prior art shown in FIGS. 4, 5 (and equivalent circuit FIG. 7), the $F_2/F_1$=2.9 bandwidth was achieved using only one MTL section, rather than the necessity of using at least three MTL modules for the two-stage prior art device shown in FIGS. 4, 5 (and equivalent circuit FIG. 7)—assuming a two-way MTL (Stage B) module followed by two five-way MTL (Stage A) modules. The prototype shown in FIGS. 8, 9, and 16 is therefore more compact and less expensive to fabricate.

Various conductive materials could be employed for the conductive components of the power divider-combiner 200. For example, in the illustrated embodiments, parts are fabricated from 6061 alloy aluminum. For corrosion resistance, some of these parts may be a) alodine coated, or b) electroless nickel flash-coated and MILspec gold plated. In other embodiments, parts are made of brass or magnesium alloy, also MILspec gold plated Another possibility is MILspec silver plated, with rhodium flash coating to improve corrosion resistance.

FIG. 18 shows an exploded view of the power divider-combiner 800, in accordance with various embodiments.

The main stepped diameter center conductor, defined by portions 808, 809, and 806, is fabricated as one piece, in the illustrated embodiments. It is bolted to the outer backplate 807 using a single ¼-20×¾" stainless steel cap screw SC3. Other size screws or other methods of attachment can be employed. Portions 808 and 809 are the center conductors for two unit element coaxial transmission lines.

In the filter circuit synthesis technique as presented in the Horton & Wenzel reference, a desired circuit response (return loss over a passband as shown in FIG. 15, for example) results from the synthesis of transmission line characteristic admittances for a sequence of one or more unit element (substantially quarter-wave at the mid-band frequency $f_O$) transmission lines followed by final unit element transmission line which is preceded and followed with unit element shorted shunt stub transmission lines, as shown in FIG. 12 for this example.

Referring to FIGS. 8, 9 and the equivalent circuit shown in FIG. 12, inner conductor 808 and outer conductor 810 form a unit element (substantially quarter-wave) transmission line with characteristic admittance $Y_1$. Inner conductor 809 and outer conductor 810 form a unit element transmission line with characteristic admittance $Y_2$. The multiconductor transmission line (MTL) consists of outer conductor 805, the quantity $N_S$ satellite conductors 803, and inner conductor 806. The equivalent circuit for this MTL is as follows (see G. Matthaei, L. Young, and E. M. T. Jones, Microwave Filters, Impedance-matching Networks, and Coupling Structures, Artech House Books, Dedham, M A, 1980, Fig. 5.09-1 a 'Schematic and Equivalent Circuit,' p. 220): 1) Electrical reference plane a-a (FIG. 12) corresponds to the physical reference plane a-a shown in FIG. 8. The outer backplate 807 in FIG. 8 serves as the short circuit for the unit element shorted shunt stub 121 in FIG. 12. The characteristic admittance is $Y_{10}=Y_{11}+N_S*Y_{12}$ for the unit element within stub 121 (FIG. 12). 2) Electrical reference plane b-b (FIG. 12) corresponds to the physical reference plane b-b shown in FIG. 8. The inner backplate 804 in FIG. 8 serves as the short circuit for the unit element shorted shunt stub 122 (FIG. 12). The characteristic admittance is $N_S*Y_{20}$ for the unit element within stub 122 (FIG. 12), where $Y_{20}=Y_{22}+Y_{12}+Y_{23}+Y_{24}+\ldots+Y_{2,11}$ (see FIG. 13 for numbering of the conductors, and FIG. 14 for the MTL admittance matrix Y). 3) Between reference planes a-a and b-b (FIG. 12) is a unit element with characteristic admittance $N_S*Y_{12}$, and having a unit element midband frequency phase length $\theta=\theta'+\theta_R$ where $\theta_R$ is the phase length of the radial transmission line 814 (FIGS. 10, 11) formed by the tip of each conductor 803 and the outer backplate conductor 807, there being quantity $N_S$ such radial transmission lines. All the above described unit elements are substantially one-quarter wavelength long at the passband mid-band frequency $f_O$. One way of interpreting a quarter-wavelength transmission line (at the midband frequency $f_O$) is that it 'transforms' the wave admittance on a Smith Chart along a circle about the origin (where the reflection coefficient magnitude is zero) exactly 180 degrees.

In the illustrated embodiments, the quantity $N_S$ output RF connectors equals ten, and the corresponding quantity $N_S$ of satellite conductors 803 is each equal to ten, requiring the modeling of an 11×11 characteristic admittance matrix Y as shown in FIG. 14. Other values of $N_S$=2, 3, . . . , 12 or more are possible. For example, a two-way divider-combiner has quantity $N_S$=2 satellite conductors (and therefore $N_S$=2 output RF connectors) requiring the modeling of a 3×3 admittance matrix Y.

In the illustrated embodiments where quantity $N_S$ equals ten, broadband performance of an octave or more is achieved different to the design of the combiner/divider described in U.S. Pat. No. 8,508,313. This is because the unit element shorted shunt stub 121 in FIG. 12 is not essential for broadband operation of the equivalent circuit of FIG. 12, whereas the shorted shunt stubs with transmission line characteristic admittances $Y_{10}^{(B)}$ and $N_S^{(B)}Y_{10}^{(A)}$ (FIG. 7) must have non-zero values in order to achieve broadband performance of the ladder filter shown in FIG. 7—(see FIG. 4*c*, U.S. Pat. No. 8,508,313 for an example of octave-performance of a two-stage MTL 8-way power divider). To show this, the characteristic admittance $Y_{10}$ for the unit element shorted shunt stub 121 (FIG. 12) is 0.00001843 mho (see FIG. 14), or essentially zero. This implies that the shorted shunt stub 121 is, for all practical consideration, deleted from the equivalent circuit FIG. 12 and that TEM waves propagating on the outer diameter of center conductor 806 (FIG. 8) see only the ground conductor inner diameter of satellite conductors 803, and not at all the inner diameter of ground conductor 805. More importantly, this also means that outer backplate 807 (FIG. 8) no longer serves also as a short circuit (for deleted stub 121, FIG. 12) but instead serves (along with the end tips of satellite conductors 803) primarily as the ground conductor for radial transmission line 814 (FIGS. 10, 11) which feeds in parallel: 1) the unit element shorted shunt stub 122 (FIG. 12), and 2) the load admittance $N_S Y_L$. The calculated scattering parameters graphed in FIG. 15 (with Y10=0) demonstrates broadband performance ($f_2/f_1$=2.91) even with the absence of the unit element shorted shunt stub 121 of FIG. 12.

In the illustrated embodiments, there are two coax unit elements having transmission line characteristic admittances Y1 and Y2 (FIG. 12) with respective center conductor portions 808, 809 (FIG. 8) that precede the multiconductor transmission line (MTL) having center conductor portion 806. However, for designs requiring less bandwidth, only one coax unit element preceding the MTL may be used. Alternatively, three or more coax unit elements preceding the MTL may be required for very broad-band designs requiring very low VSWR (voltage standing wave ratio) throughout the passband, as measured at the divider input port.

In various embodiments, the flange 812 and coax outer conductor 810 are machined as one piece. Alternatively, flange 812 and coax outer conductor 810 may be separate pieces soldered, brazed, or bolted together. Bolted to the coax outer conductor 810 is flange 811, which may also be alternatively brazed or soldered instead of bolted together. Using four stainless steel cap screws SC1 from behind (see FIG. 18), flange 811 sandwiches inner backplate 804 to thread into four corresponding threaded holes in the back face (hidden from view) of MTL outer conductor 805, in various embodiments. Other mechanical attachment methods can be employed.

In the illustrated embodiments, the satellite conductors 803 form one piece with conducting inner backplate 804—this is one solid piece. However, satellite conductors 803 might be bolted, soldered, or brazed, or press fit onto conducting inner back plate 804.

Divider output connectors 801 (FIGS. 8, 9, 18) are shown as flange mounted Type N (female) connectors. Each output connector (only one of ten connectors 801 is shown in FIG. 18) mounts to the MTL outer conductor 805 using two 4-40×3/16" cap screws SC4 (FIG. 18). Other Type N (female, or male) mounting types and other mechanical attachments can be employed. Other kinds of output RF connectors, such as TNC, SMA, SC, 7-16 DIN, 4.3-10 DIN male or female, and other EIA-type flanges can be employed. The mating end of center conductor 802 of the output connector 801 is slotted in the illustrated embodiments (see FIGS. 8, 9, 10, 18) to provide a snug fit to the receiving hole 817 (FIGS. 10, 11) reamed in its respective satellite conductor 803. This is a removable RF connector approach, but solder or braze alloy 816 (FIG. 11) may be otherwise used to form a permanent connection.

In the illustrated embodiments, the stepped center conductor plus backplate 808, 809, 806, 807 assembly is bolted to the end interior of MTL ground conductor 805 by means of five 6-32×5/8" stainless steel cap screws SC2 (FIG. 18). Other mechanical attachment methods can be employed.

Referring to FIG. 13, the MTL cross-section dimensions were adjusted, in various embodiments, so that the MTL admittance matrix Y shown in FIG. 14 yielded the desired quantities for $Y_{12}$, $Y_{10}$, and $Y_{20}$.

In compliance with the patent statutes, the subject matter disclosed herein has been described in language more or less specific as to structural and methodical features. However, the scope of protection sought is to be limited only by the following claims, given their broadest possible interpretations. Such claims are not to be limited by the specific features shown and described above, as the description above only discloses example embodiments.

The invention claimed is:

1. A power divider/combiner comprising:

a main conductor defining an axis;

an input connector having a center conductor, adapted to be coupled to a signal source, electrically coupled to the main conductor and having an axis aligned with the main conductor axis, and having a second conductor electrically coupled to a ground conductor;

a plurality of satellite conductors radially exterior of and spaced apart from the main conductor, each satellite conductor being parallel to the main conductor axis, the satellite conductors defining the general shape of a slotted hollow cylinder having a cylinder axis along its length being coincident with the main conductor axis;

a second ground conductor radially exterior of the satellite conductors;

a plurality of output connectors having respective axes that are perpendicular to the main conductor axis, the output connectors being radially spaced apart relative to the main conductor, the output connectors having center conductors electrically coupled to respective satellite conductors and having respective second conductors electrically coupled to the second ground conductor; and a multiconductor transmission line, including the satellite conductors, the second ground conductor, and the main conductor, the second ground conductor and the main conductor being parallel to the main conductor axis.

2. A power divider/combiner in accordance with claim 1 and further comprising an outer conductor radially exterior of the main conductor and electrically coupled to the second conductor of the input connector to define the first ground conductor.

3. A power divider/combiner in accordance with claim 1 wherein the satellite conductors are respectively electrically about one-quarter wavelength long at a passband midband frequency.

4. A power divider/combiner in accordance with claim 1 and having a first end defined by the input connector and having a second end, the output connectors being proximate the second end, and further comprising an inner backplate that is electrically and thermally conducting, between the first and second ends, radially exterior of the main conductor, and wherein the satellite conductors have inner ends electrically coupled to the backplate and outer ends that are electrically coupled to the center conductors of the output connectors.

5. A power divider/combiner in accordance with claim 4 and further comprising an electrically and thermally conducting outer backplate at the second end electrically coupled to the main conductor and spaced apart from the satellite conductors by a gap.

6. A power divider/combiner in accordance with claim 5 wherein a radial transmission line is defined between the outer backplate and the outer ends of the satellite conductors.

7. A power divider/combiner in accordance with claim 4 and further comprising an outer conductor radially exterior of the main conductor and connected to the second conductor of the input connector to define the first ground conductor, and a second outer ground conductor radially exterior of the satellite conductors, spaced apart from the first outer ground conductor by the inner backplate, and electrically coupled to the second conductors of the output connectors.

8. A power divider/combiner in accordance with claim 7 wherein the multiconductor transmission line is defined by the satellite conductors, the second ground conductor, and the main conductor.

9. A power divider/combiner comprising:

a stepped main conductor defining an axis;

an input connector having a center conductor, adapted to be coupled to a signal source, electrically coupled to the main conductor and having an axis aligned with the main conductor axis, and having a second conductor electrically coupled to a ground conductor, the power divider/combiner having a first end defined by the input connector and having a second end;

a plurality of satellite conductors radially exterior of and spaced apart from the main conductor, the satellite conductors defining the general shape of a slotted hollow cylinder having a cylinder axis aligned with the main conductor axis;

a plurality of output connectors, proximate the second end, having respective axes that are perpendicular to the main conductor axis, the output connectors being radially spaced apart relative to the main conductor, the output connectors having center conductors electrically coupled to respective satellite conductors and having respective second conductors electrically coupled to a second ground conductor;

a multiconductor transmission line, including the satellite conductors, defined between the input connector and the output connectors; and an inner backplate that is electrically and thermally conducting, between the first and second ends, radially exterior of the main conductor, the satellite conductors have inner ends electrically coupled to the inner backplate and outer ends that are electrically coupled to the center conductors of the output connectors.

10. A power divider/combiner in accordance with claim 9 and further comprising an outer conductor radially exterior of the main conductor and electrically coupled to the second conductor of the input connector to define the first ground conductor.

11. A power divider/combiner in accordance with claim 9 wherein the multiconductor transmission line is electrically about one-quarter wavelength long at a passband midband frequency.

12. A power divider/combiner in accordance with claim 9 and further comprising an electrically and thermally conducting outer backplate at the second end electrically coupled to the main conductor and spaced apart from the satellite conductors by a gap.

13. A power divider/combiner in accordance with claim 12 wherein a radial transmission line is defined between the outer backplate and the outer ends of the satellite conductors.

14. A power divider/combiner in accordance with claim 9 and further comprising an outer conductor radially exterior of the main conductor and connected to the second conductor of the input connector to define the first ground conductor, and a second outer ground conductor radially exterior of the satellite conductors, spaced apart from the first outer ground conductor by the inner backplate, and electrically coupled to the second conductors of the output connectors.

15. A power divider/combiner in accordance with claim 14 wherein the multiconductor transmission line is defined by the satellite conductors, the second ground conductor, and the main conductor.

16. A power divider/combiner comprising:

a main conductor defining an axis, and having a length along the axis, the main conductor including three different diameters along its length defining multiple portions;

an input connector having a center conductor, adapted to be coupled to a signal source, electrically coupled to the main conductor and having an axis aligned with the main conductor axis, and having a second conductor, the input connector defining a first end of the combiner/divider, the combiner/divider having a second end axially spaced apart from the first end;

a first ground conductor radially exterior of the main conductor and coupled to the second conductor of the input connector;

an electrically and thermally conducting inner backplate, axially between the first ground conductor and the second end, radially exterior of the main conductor;

a plurality of satellite conductors radially exterior of and radially spaced apart from one of the portions of the main conductor, the satellite conductors defining the general shape of a slotted hollow cylinder having a cylinder axis aligned with the main conductor axis, the satellite conductors having inner ends electrically connected to the inner backplate and outer ends extending towards the second end;

a plurality of output connectors having respective axes that are perpendicular to the main conductor axis, the output connectors being radially spaced apart relative to the main conductor axis, the output connectors having center conductors electrically coupled to respective outer ends of the satellite conductors and having respective second conductors electrically coupled to a second ground conductor;

a second ground conductor radially exterior of the satellite conductors and axially between the inner backplate and the second end; and an electrically and thermally conducting outer backplate at the second end electrically coupled to the main conductor and spaced apart from the satellite conductors by a gap.

17. A power divider/combiner in accordance with claim 16 wherein a multiconductor transmission line is defined by the satellite conductors, the main conductor, and the second ground conductor.

18. A power divider/combiner in accordance with claim 17 wherein the main conductor has a first portion proximate the first end, a second portion having a diameter greater than the diameter of the first portion, adjacent the first portion and proximate the inner backplate, and a third portion having a diameter greater than the diameter of the second portion, adjacent the second portion and proximate the satellite conductors.

19. A power divider/combiner in accordance with claim 18 wherein a first coaxial element transmission line, in signal communication with the multiconductor transmission line, is defined by the second portion of the main conductor and the first ground conductor.

20. A power divider/combiner in accordance with claim 18 and including a plurality of coaxial element transmission lines, in signal communication with the multiconductor transmission line.

21. A power divider/combiner in accordance with claim 20 wherein the multiconductor transmission line and the coaxial element transmission lines are electrically modeled to define a passband filter.

22. A method of manufacturing a power divider/combiner, the method comprising:

providing a main conductor defining an axis;

providing a coax input connector having a center conductor, adapted to be coupled to a signal source and having an axis aligned with the main conductor axis;

electrically coupling the input connector to the main conductor;

providing a plurality of satellite conductors radially exterior of and spaced apart from the main conductor, the satellite conductors defining the general shape of a slotted hollow cylinder having a cylinder axis aligned with the main conductor axis, respective satellite conductors having a length parallel to the axis, the satellite conductors being parallel to each other and to the axis uniformly along their lengths;

providing a plurality of coax output connectors having respective axes that are perpendicular to the main conductor axis, the output connectors being radially spaced apart relative to the main conductor, the output connectors having center conductors;

providing an electrically and thermally conducting inner backplate, radially exterior of the main conductor;

electrically coupling the respective center conductors of the output connectors to the satellite conductors;

defining a multiconductor transmission line between the inner backplate and the output connectors; and defining a passband filter between the input connector and the output connectors.

23. A method in accordance with claim 22 wherein defining a passband filter comprises defining steps in the main conductor.

24. A method in accordance with claim 22 wherein the input connector includes an exterior conductor, wherein the output connectors include respective exterior conductors, and wherein the inner backplate is provided axially between the first ground conductor and the output connectors; the method further comprising providing a first ground conductor radially exterior of the main conductor; coupling the first ground conductor to the second conductor of the input connector; providing a second ground conductor radially exterior of the satellite conductors and axially between the inner backplate and the exterior conductors of the output connectors; and electrically coupling the second ground conductor to the exterior conductors of the output connectors.

25. A method in accordance with claim 24 wherein the multiconductor transmission line is defined by the main center conductor, the satellite conductors, and the second ground conductor.

* * * * *